US007377838B1

(12) United States Patent
Van Vliet

(10) Patent No.: US 7,377,838 B1
(45) Date of Patent: May 27, 2008

(54) FLOOR TREATING MACHINE

(75) Inventor: Johannes petrus Van Vliet, Alphen a/d Rijn (NL)

(73) Assignee: Holland Industriele Diamantwerken B.V., Ter Aar (NL)

( * ) Notice: Subject to any disclaimer, the term of this patent is extended or adjusted under 35 U.S.C. 154(b) by 0 days.

(21) Appl. No.: 11/649,330

(22) Filed: Jan. 3, 2007

(51) Int. Cl.
*B24B 23/00* (2006.01)

(52) U.S. Cl. ..... 451/353; 451/357; 451/359; 15/49.1

(58) Field of Classification Search ..... 451/353, 451/357, 359; 15/49.1
See application file for complete search history.

(56) References Cited

U.S. PATENT DOCUMENTS 4,719,659 A * 1/1988 Urakami ..... 15/49.1
6,238,277 B1 * 5/2001 Duncan et al. ..... 451/271
7,226,347 B1 * 6/2007 Padgett et al. ..... 451/353
2003/0040265 A1 * 2/2003 Palushi ..... 451/350
2004/0023608 A1 * 2/2004 Van Vliet et al. ..... 451/350
2006/0026781 A1 * 2/2006 Van Vliet ..... 15/49.1
2007/0184762 A1 * 8/2007 Dummermuth-Furter ... 451/353

* cited by examiner

*Primary Examiner*—Eileen P. Morgan
(74) *Attorney, Agent, or Firm*—The Webb Law Firm

(57) ABSTRACT

A floor treating machine has a frame and a housing connected rotatably to the frame according to a main rotation axis. At least three heads are suspended rotatably with respect to the housing according to respective rotating axes, which are generally parallel to the main rotation axis, as well as a number of drive motors which is at least equal to the number of heads. Each head is connected to its own respective drive motor.

3 Claims, 5 Drawing Sheets

FLOOR TREATING MACHINE

BACKGROUND OF THE INVENTION

1) Field of the Invention

The invention is related to a floor treating machine comprising a frame, a housing connected rotatably to the frame according to a main rotation axis, at least three heads which are suspended rotatably with respect to the housing according to respective auxiliary rotating axes which are generally parallel to the main rotation axis, as well as a number of drive motors which is at least equal to the number of heads, wherein each head is connected to the shaft of its own respective drive motor.

The floor treating machine in question can be used for several purposes, such as for the grinding of floors consisting of natural stone, such as marble. However, the floor treating machine in question can also be used for grinding concrete surfaces. Furthermore, applications in the field of cleaning are possible, and further applications are related to the field of polishing. Dependent on the type of use, the heads are provided with suitable discs for e.g. grinding purposes, cleaning purposes, polishing purposes etc.

2) Description of the Related Art

A floor treating machine is disclosed in U.S. Pat. No. 4,719,659, and comprises a frame or main supporting member with a central hub portion from which three interconnected supporting arms extend radially outwardly. In turn, the three supporting arms are provided with terminal hub portions at their free ends, onto which terminal hub portions C-shaped frames are connected. The heads are connected to the lower end of said C-shaped frames. Furthermore, each C-shaped frame carries an electric drive motor connected to a respective head.

By means of an intricate system of rods and sliding members, a self-travelling function of the floor treating machine is obtained once the heads are brought into rotation by their respective drive motors. In this connection, the three interconnected supporting arms are rotated dependent on the rotation of the heads.

The disadvantage of this prior art floor treating machine is related to its complicated structure, including sliding members and the rods which are prone to damage and soiling which could lead to malfunctions.

The object of the invention is to provide a floor treating machine of the type described before which is of a more simple layout and which nevertheless is able to provide good results concerning manoeuvrability. Furthermore, the floor treating machine should be able to provide a high quality finishing operation.

SUMMARY OF THE INVENTION

This object is obtained in that an orbital drive has been provided between the frame and the housing for making the housing rotate with respect to the frame. By providing an orbital drive, in addition to the separate drives for each head, several advantages are obtained. In the first place, a good control by the operator of the floor treating machine is possible through the controlled rotation of the housing. This rotation is no longer dependant on the rotary movement of the heads, as is the case with the prior art treating machine, but is dictated by the orbital drive which can be selected in such a way that the desired results are obtained. Moreover, having regard to this control of rotation of the housing which contains the rotary heads, the surface in question can be treated in a balanced way.

The heads can be connected in different ways with respect to the drive motor. Preferably, they are directly connected to the drive motor in question, whereby for instance a damper can be included so as to absorb irregularities in the surface. Alternatively, each head can be connected to the shaft of the respective drive motor through a transmission.

The orbital drive according to the invention can be carried out in several ways as well. According to a first possibility, the orbital drive can be obtained by using one of the drive motors for the heads. In this connection, the shaft of at least one of the drive motors which is connected to a head, can be furthermore connected to the frame for establishing the orbital rotation of the housing with respect to the frame. Such shaft protrudes from the motor casing at the end thereof opposite the head. Usually, the heads are rotated at a relatively high speed, which means that in this embodiment of the orbital drive a decelerating orbital transmission is applied between said shaft and the frame. This decelerating orbital transmission is selected in such a way that the desired ratio is obtained between the rotational speed of the heads and the orbital speed of the housing. The transmission can be carried out in several ways; preference is given to an embodiment wherein the orbital transmission between the drive motor shaft connected to a head and the frame comprises at least one pulley as well as respective pulley wheels, wherein a pulley wheel with a relatively small diameter is connected to an end of the shaft of the drive motor opposite the end of the shaft that is connected to the head, and a pulley wheel with a relatively large diameter is connected to the frame.

According to an alternative embodiment, the orbital drive comprises a further drive motor, in addition to the drive motors which are connected to a head, which is connected to the housing and to the frame for making the housing rotate with respect to the frame. In this case, the housing is driven in rotation in a way which is fully independant from the rotation of the heads. In particular, the motor casing of the further drive motor can be connected to the housing, the motor shaft of said further drive motor cooperating with the frame through a transmission. This transmission can be carried out in several ways as well, and in particular it can comprise a pulley transmission.

For instance, the motor shaft of the further drive motor is provided with a pulley wheel with a relatively small diameter, and the frame is provided with a pulley wheel with a relatively large diameter, around which pulley wheels a pulley has been guided.

In a further alternative embodiment, the motor casing of the further drive motor is connected to the frame, and the motor shaft of said further drive motor engages with the housing through a transmission. In that case, the housing is provided with a pulley wheel with a relatively large diameter, and the motor shaft of the further drive motor is provided with a pulley wheel with a relatively small diameter.

The electric supply of the motors, the casing of which is connected to the housing, may comprise a sliding contact between the housing and the frame. Furthermore, the frame may be provided with an operation means which can be gripped by an operator.

BRIEF DESCRIPTION OF THE DRAWINGS

The invention will now be described further with reference to the embodiment is shown in the drawings.

DETAILED DESCRIPTION OF THE INVENTION

Figure 1:
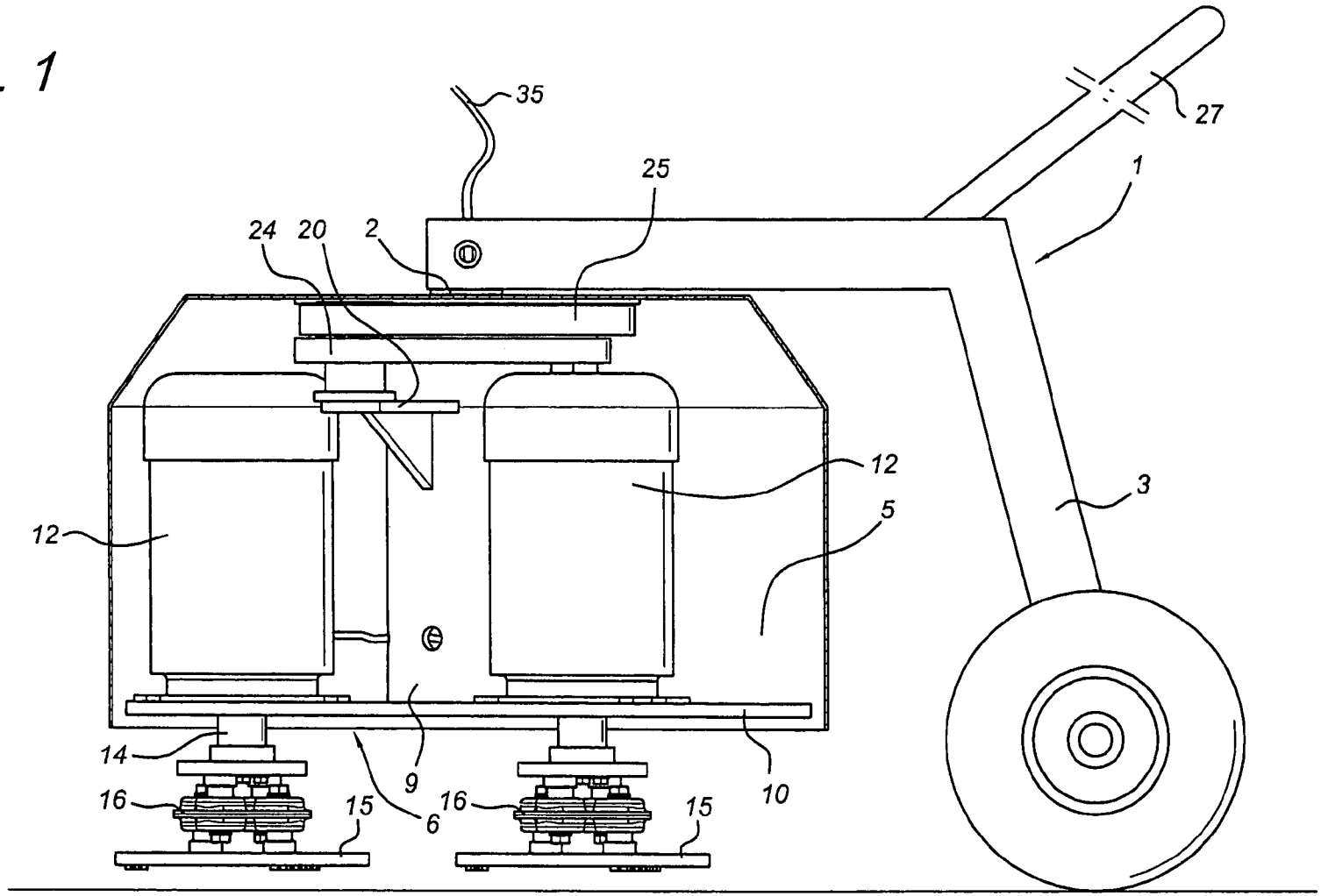
FIG. 1 shows a side view of a first embodiment of the floor treating machine according to the invention.
Figure 2:
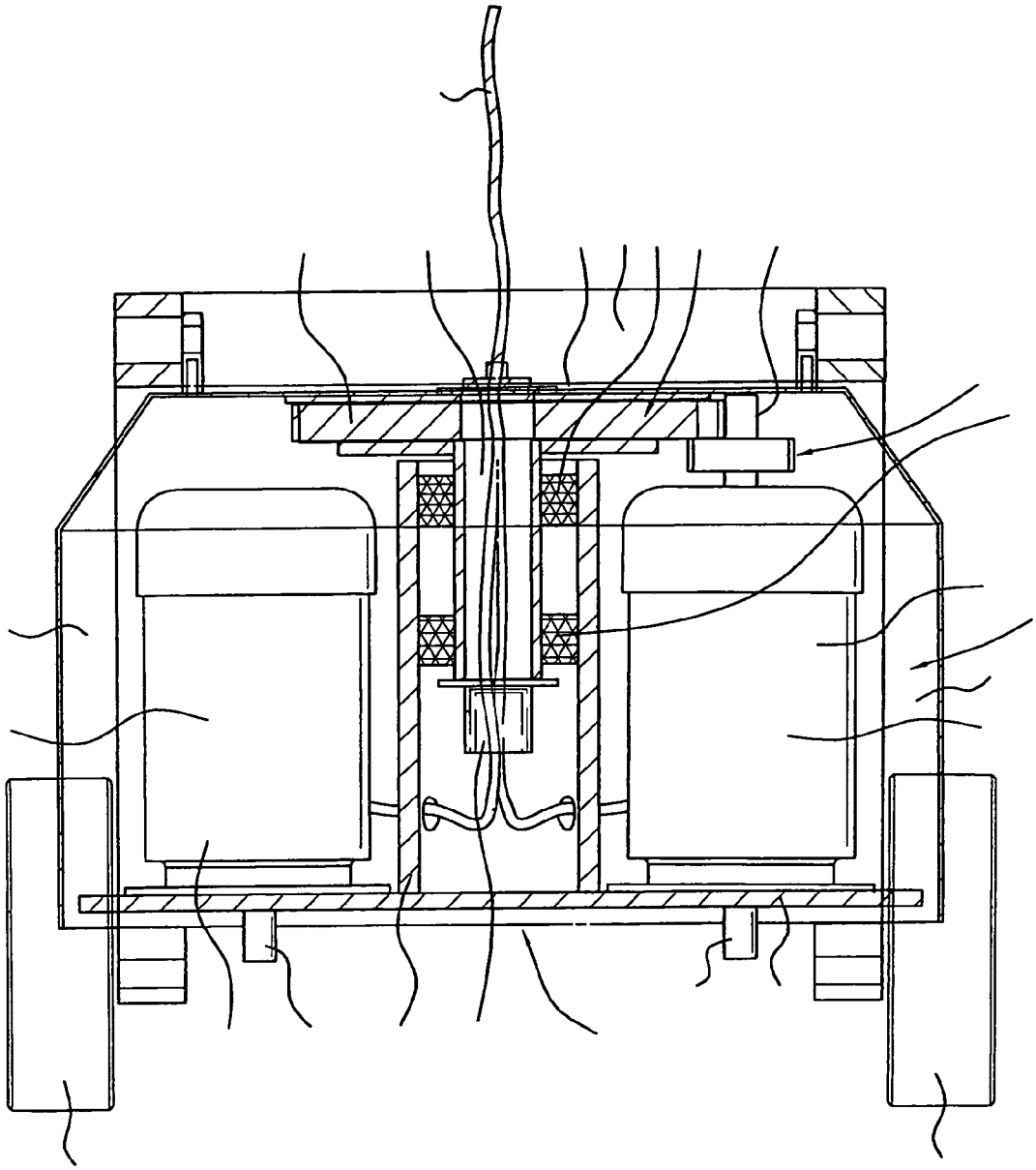
FIG. 2 shows a front view of the floor treating machine according to FIG. 1.
Figure 3:
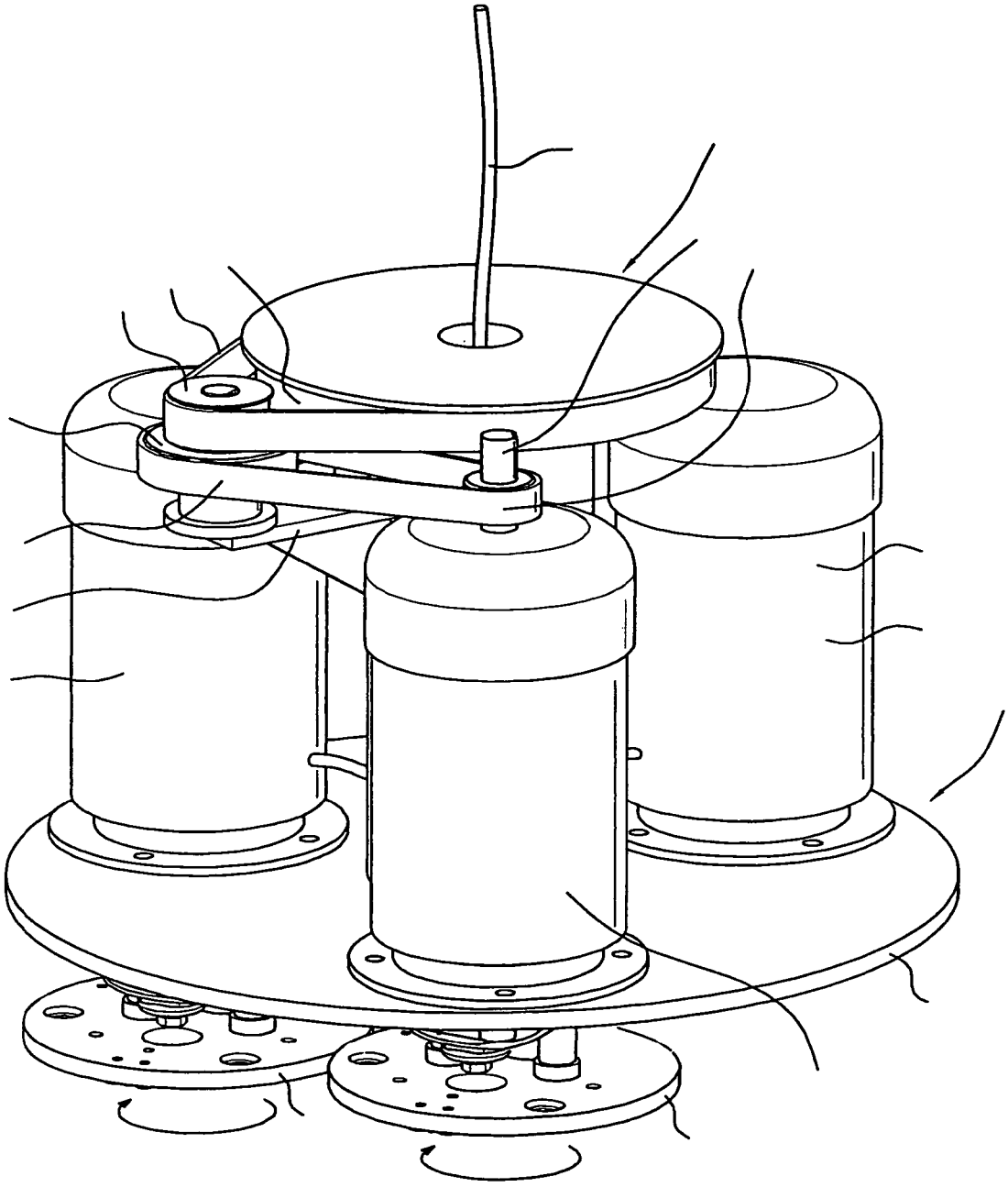
FIG. 3 shows a view in perspective of a part of the floor treating machine according to the FIGS. 1 and 2.
Figure 4:
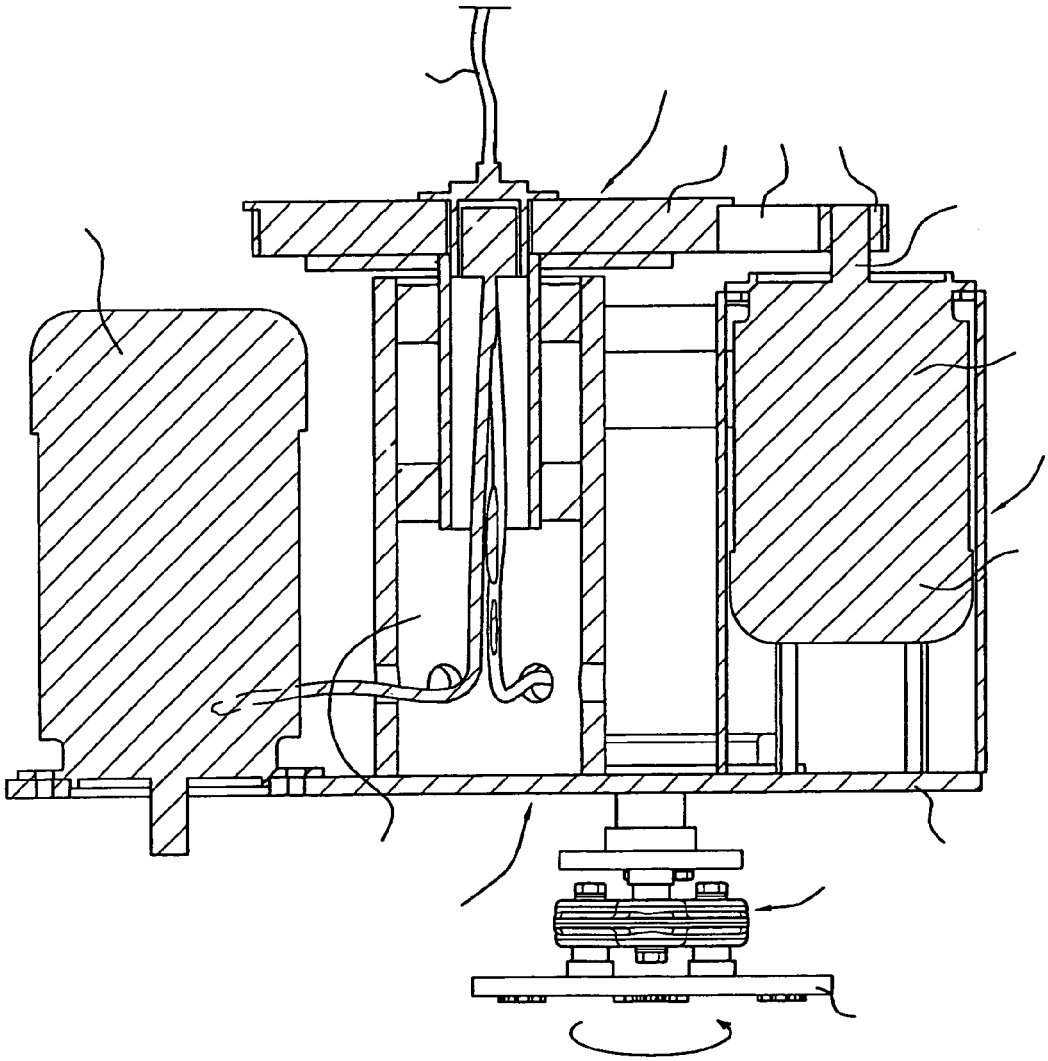
FIG. 4 shows a side view of a part of a second embodiment of the floor treating machine according to the invention.

The floor treating machine as shown in FIGS. 1-3 comprises a carriage 1, which comprises legs 2, 3 which are interconnected by a crossbeam 4, as well as a frame 5 suspended from the crossbeam 4. A housing 6 is suspended from the frame 5, in such a way that it is rotatable with respect to vertical axis. In this connection, the frame 5 comprises a downwardly extending rod 11, from which by means of rolling element bearings 7, 8 a tube 9 of wider diameter is suspended. This tube 9 is welded to a base plate 10, said tube 9 and the base plate 10 forming part of the housing 6 which through the bearings 7, 8 is rotatable with respect to the frame 5.

On the upper side of the base plate 10, three drive motors 12 are mounted. Said drive motors can each comprise a housing 13, connected to the base plate 10, as well as a drive shaft 14 which freely protrudes through a corresponding hole in the base plate 10. As shown in FIGS. 1 and 3, a head 15 is connected to each shaft 14 by means of a damper 16. Thus, each head 15 is driven in rotation by means of its own drive motor 12.

The rotation of the housing 6 with respect to the frame 5 is made possible in that one of the drive motors 12 has a drive shaft 14 which extends at both ends out of the housing 12, the upper protruding end being indicated by reference numeral 17. A pulley wheel 18 of a relatively small diameter is mounted on said protruding upper end 17 of the drive shaft in question. Furthermore, a first auxiliary pulley wheel 19 of a relatively large diameter is rotatably mounted with respect to the housing on the beam 20; a second auxiliary pulley wheel 21 is fixedly and concentrically connected to the auxiliary pulley wheel 19 with a relatively large diameter. Furthermore, a fixed pulley wheel 22 with relatively large diameter is connected to the frame 5, in particular to an upper plate 23 thereof from which the rod 11 extends downwardly.

A first auxiliary pulley 24 extends around the pulley wheel 18 mounted on the upper end 17 of the motor shaft 14 as well as around the auxiliary pulley wheel with relatively large diameter 19. A second auxiliary pulley 25 extends around the auxiliary pulley wheel 21 with a relatively small diameter, as well as around the fixed pulley wheel 22.

By a rotating the drive motors 12 for the heads 15, also the upwardly extending end 17 is brought in rotation. As said upwardly extending end 17 is connected, through its pulley wheel 18, to the fixed pulley wheel 22 mounted on the frame 5, the housing 6 is thereby brought in rotation with respect to said frame 5.

The carriage 1 is furthermore provided with wheels 26, as well as a handle 27 for displacing the floor treating machine in question and for steering this. In the electrical cable 35 for supplying electrical current to do drive motors 12, a sliding coupling 34 has been provided at the lower end of the rod 11.

Figure 5:
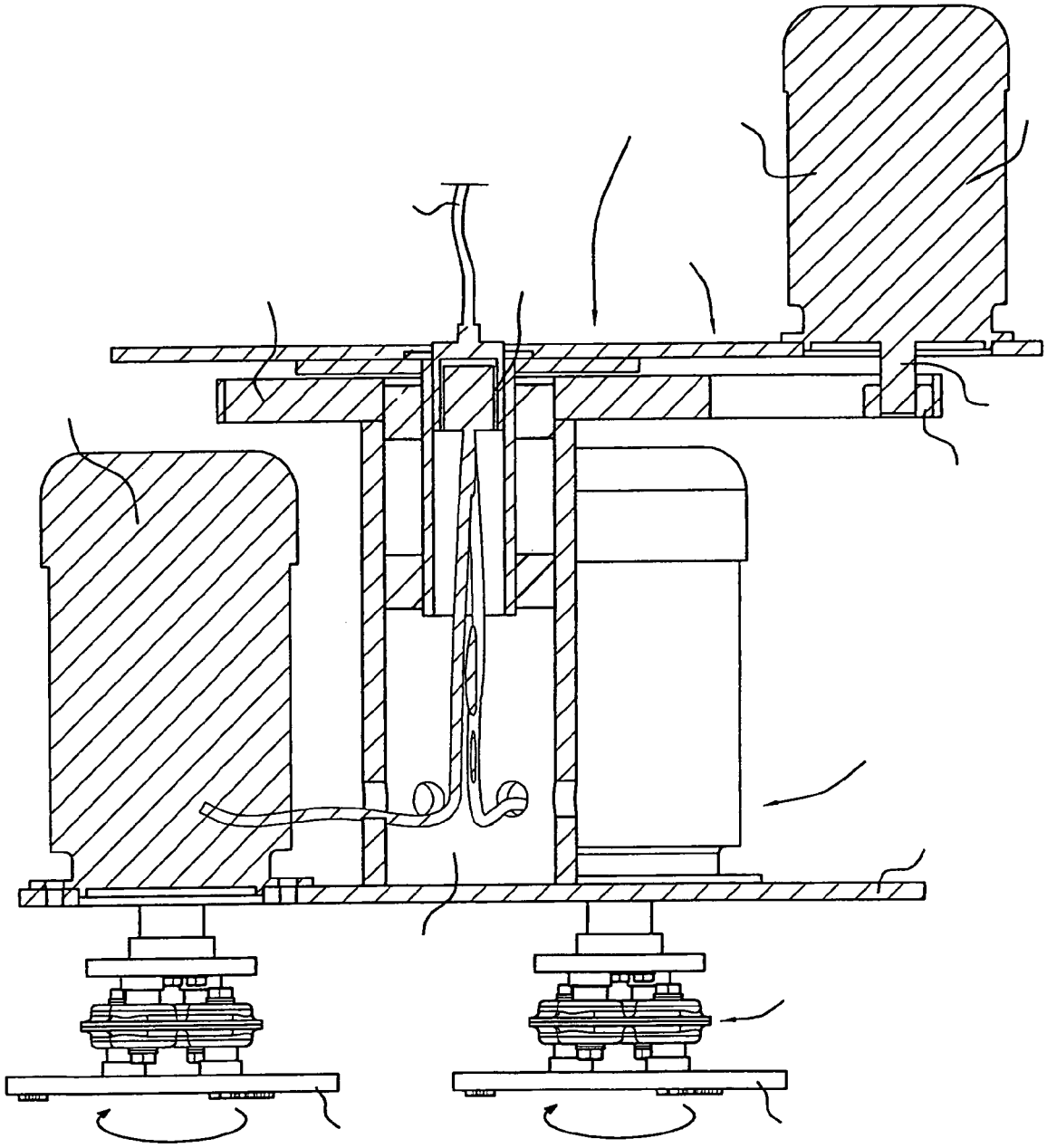
FIG. 5 shows a side view of a third embodiment of the floor treating machine according to the invention.
Figure 1:
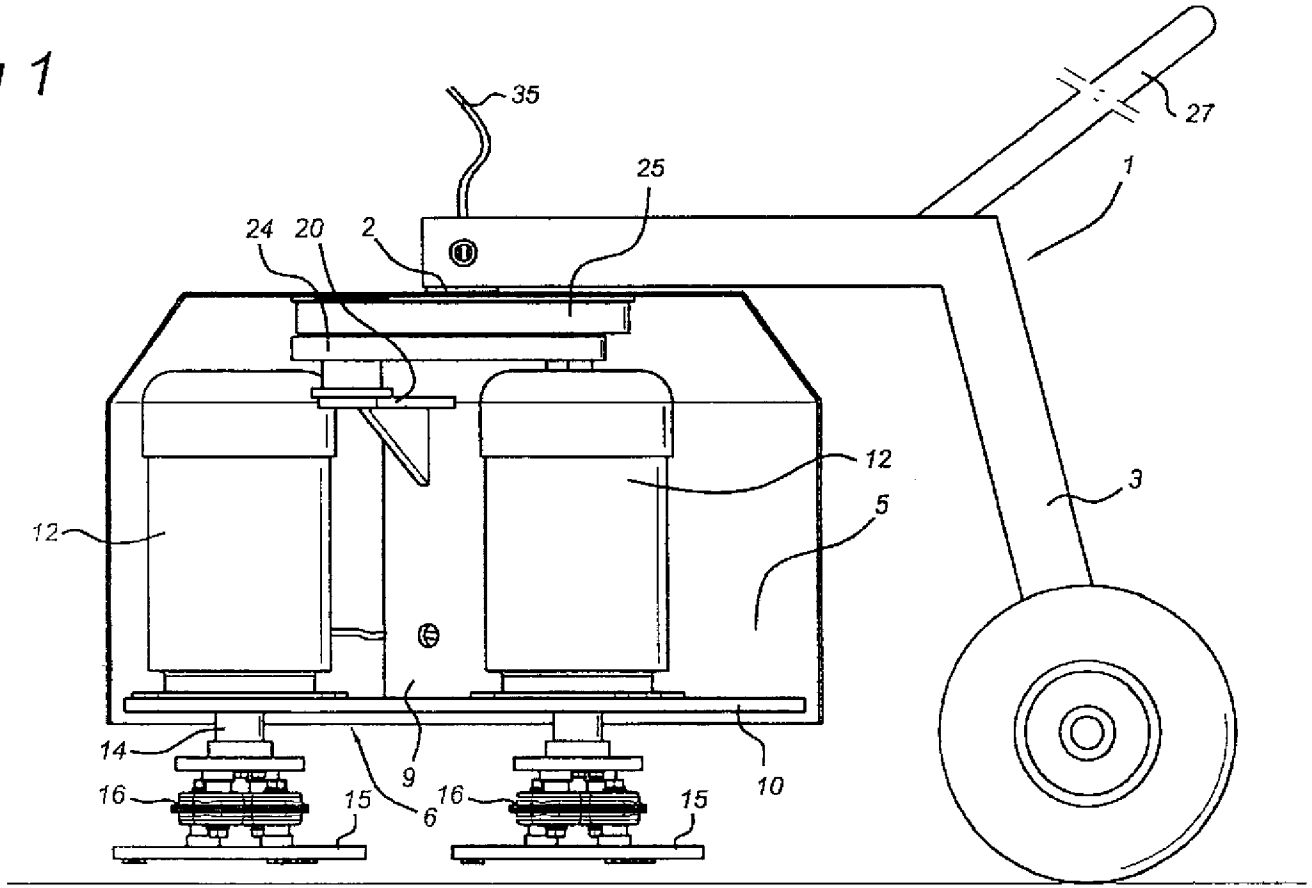
Figure 2:
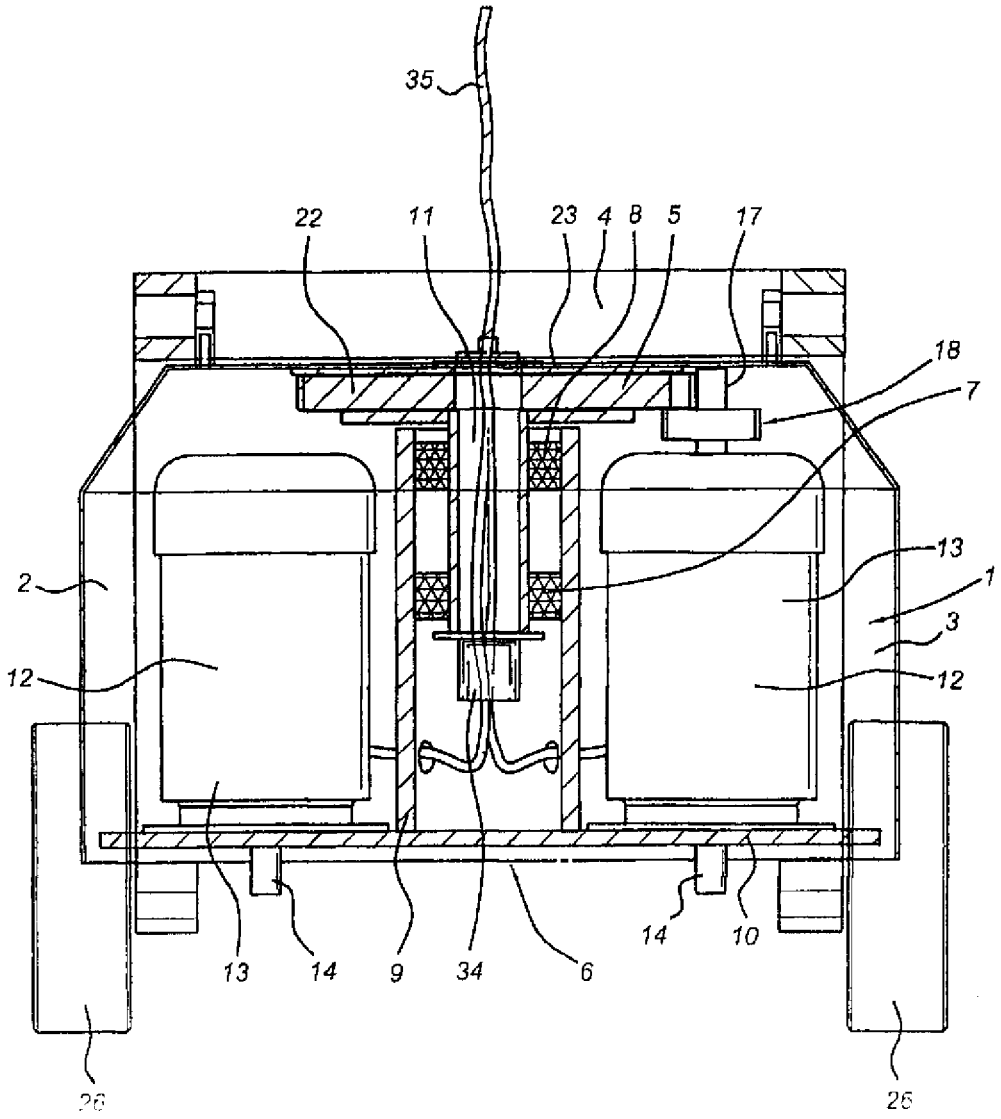
Figure 3:
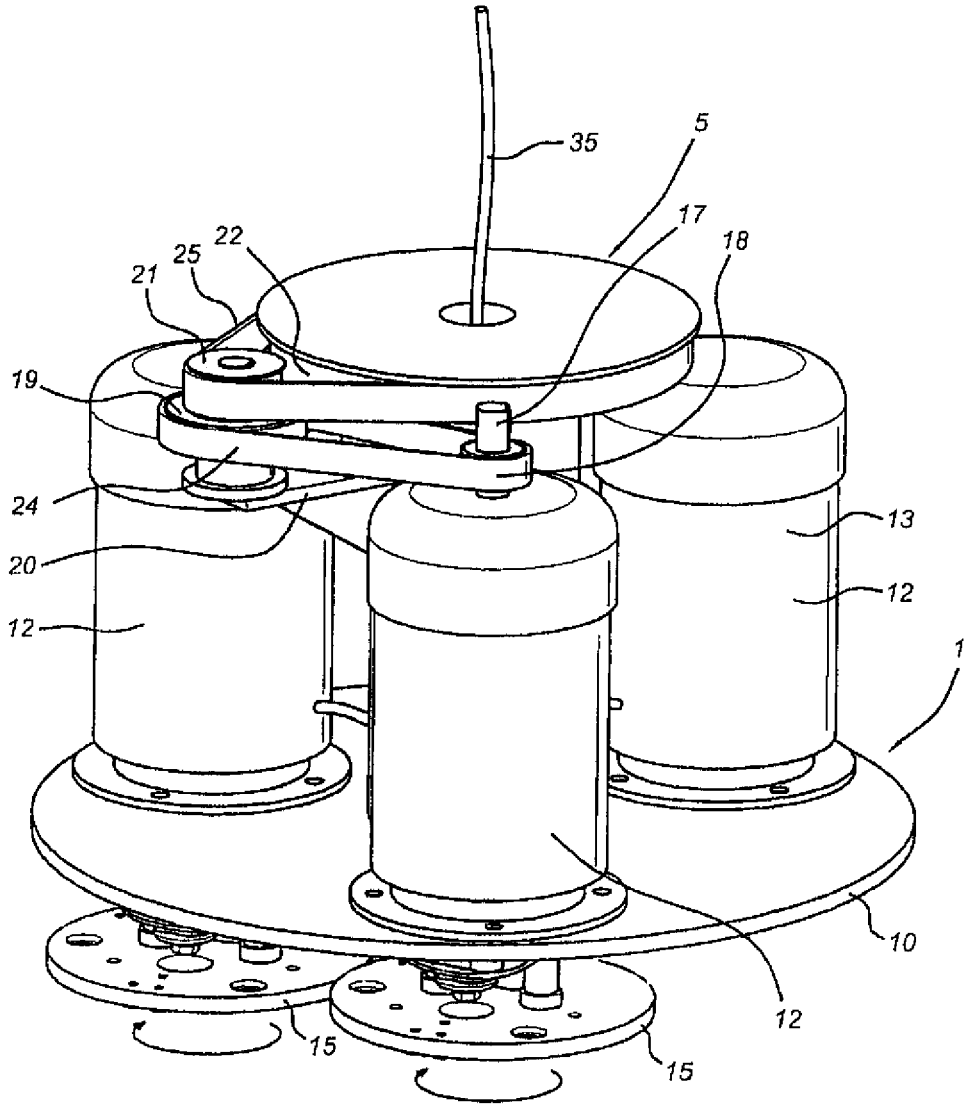
Figure 4:
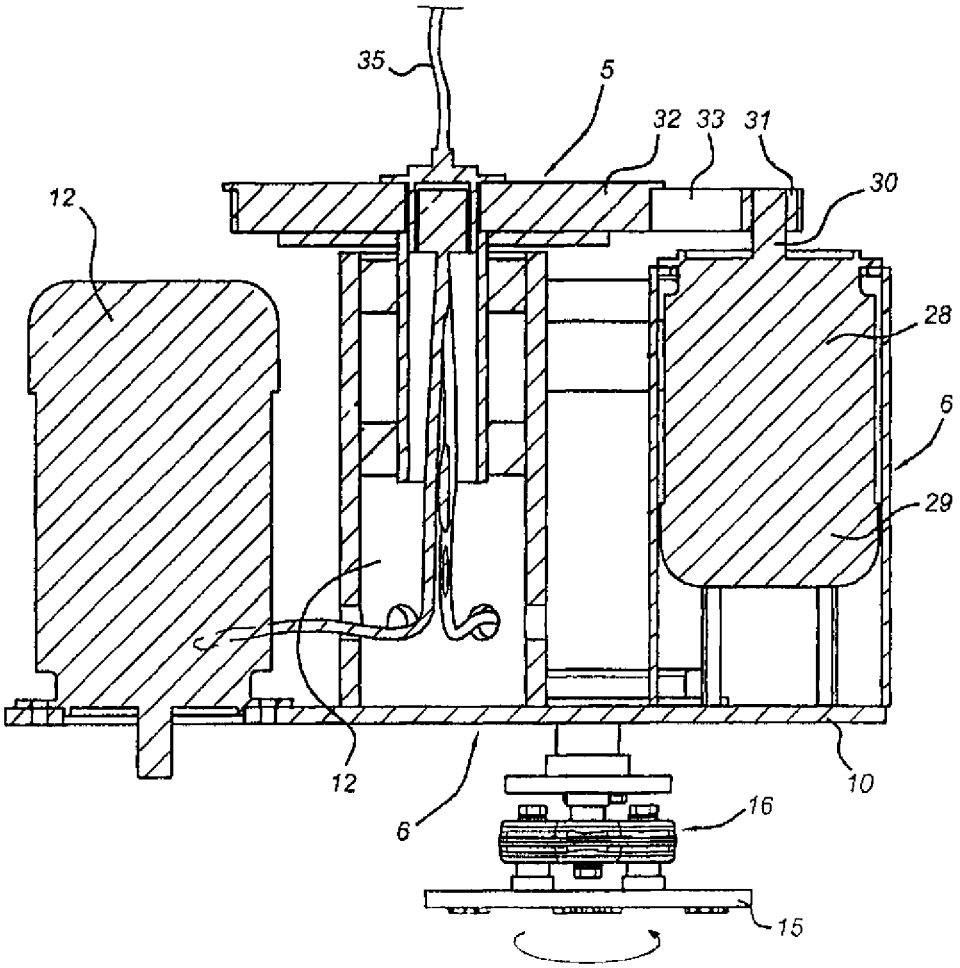
Figure 5:
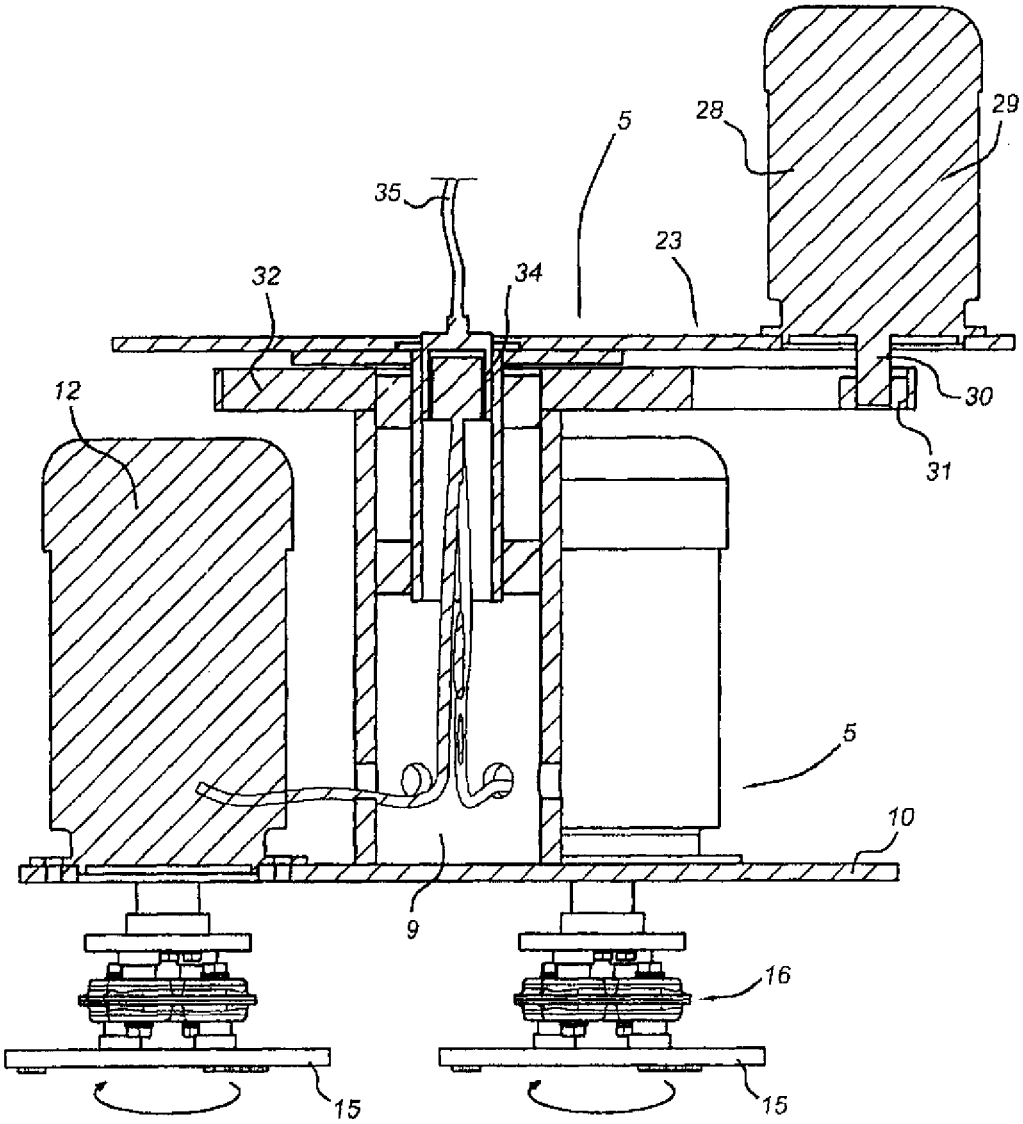

According to the embodiment shown in FIG. 5, a further drive motor 28 is provided in addition to the drive motors 12 for the heads 15. The housing 29 of said further drive motor 28 is connected to the housing 6. The upwardly protruding shaft 30 of said drive motor 28 carries a pulley wheel 31 with a relatively small diameter. The frame 5 is provided with a fixed pulley wheel 32; around said pulley wheels 31,32 the pulley 33 extends. By making the drive shaft of the further drive motor 28 rotate, the housing 6 is brought in rotation with respect to the frame 5.

The embodiment of FIG. 5 comprises a further drive motor 28 the housing 29 of which is fixed to the plate 23 of the frame 5. The downwardly extending drive shaft 30 of said further drive motor 28 carries a pulley wheel 31 with a relatively small diameter, whereas the pulley wheel 32 with a relatively large diameter is connected to the frame 5. By rotating the shaft of the further drive motor 29, the housing 6 is brought into rotation with respect to the frame 6.

The invention claimed is:

1. A floor treating machine, comprising a frame, a housing connected rotatably to the frame according to a main rotation axis, at least three heads which are suspended rotatably with respect to the housing according to respective auxiliary rotating axes which are generally parallel to the main rotation axis, as well as a number of drive motors which are at least equal to the number of heads, wherein each head is connected to the shaft of its own respective drive motor, wherein an orbital drive has been provided between the frame and the housing for making the housing rotate with respect to the frame, and wherein the shaft of at least one of the drive motors which is connected to a head, is furthermore connected to the frame for establishing the orbital rotation of the housing with respect to the frame.

2. The floor treating machine according to claim 1, wherein the orbital drive comprises a decelerating orbital transmission between said shaft and the frame.

3. The floor treating machine according to claim 2, wherein the orbital transmission between the drive motor shaft connected to a head and the frame comprises at least one pulley as well as respective pulley wheels, wherein a pulley wheel with a relatively small diameter is connected to an end of the shaft of the drive motor opposite the end of the shaft that is connected to the head, and a pulley wheel with a relatively large diameter is connected to the frame.

* * * * *

UNITED STATES PATENT AND TRADEMARK OFFICE

CERTIFICATE OF CORRECTION

PATENT NO. : 7,377,838 B1
APPLICATION NO. : 11/649330
DATED : May 27, 2008
INVENTOR(S) : Van Vliet and Johannes Petrus It is certified that error appears in the above-identified patent and that said Letters Patent is hereby corrected as shown below:

The title page showing the illustrative figure should be deleted to be replaced with the attached title page.

The drawing sheet, consisting of Figs. 1-5, should be deleted to be replaced with the drawing sheet, consisting of Figs. 1-5, as shown on the attached pages.

Signed and Sealed this

Tenth Day of November, 2009

David J. Kappos

David J. Kappos
*Director of the United States Patent and Trademark Office*

(12) United States Patent
Van Vliet

(10) Patent No.: US 7,377,838 B1
(45) Date of Patent: May 27, 2008

(54) FLOOR TREATING MACHINE

(75) Inventor: Johannes petrus Van Vliet, Alphen a/d Rijn (NL)

(73) Assignee: Holland Industriele Diamantwerken B.V., Ter Aar (NL)

( * ) Notice: Subject to any disclaimer, the term of this patent is extended or adjusted under 35 U.S.C. 154(b) by 0 days.

(21) Appl. No.: 11/649,330

(22) Filed: Jan. 3, 2007

(51) Int. Cl.
*B24B 23/00* (2006.01)

(52) U.S. Cl. ..... 451/353; 451/357; 451/359; 15/49.1

(58) Field of Classification Search ..... 451/353, 451/357, 359; 15/49.1
See application file for complete search history.

(56) References Cited

U.S. PATENT DOCUMENTS 4,719,659 A * 1/1988 Urakami ..... 15/49.1
6,238,277 B1 * 5/2001 Duncan et al ..... 451/271
7,226,347 B1 * 6/2007 Padgett et al. ..... 451/353
2003/0040265 A1 * 2/2003 Pakishi ..... 451/350
2004/0023608 A1 * 2/2004 Van Vliet et al. ..... 451/350
2006/0026781 A1 * 2/2006 Van Vliet ..... 15/49.1
2007/0184762 A1 * 8/2007 Dummermuth-Furler ... 451/353

* cited by examiner

*Primary Examiner*--Eileen P. Morgan
(74) *Attorney, Agent, or Firm*--The Webb Law Firm

(57) ABSTRACT

A floor treating machine has a frame and a housing connected rotatably to the frame according to a main rotation axis. At least three heads are suspended rotatably with respect to the housing according to respective rotating axes, which are generally parallel to the main rotation axis, as well as a number of drive motors which is at least equal to the number of heads. Each head is connected to its own respective drive motor.

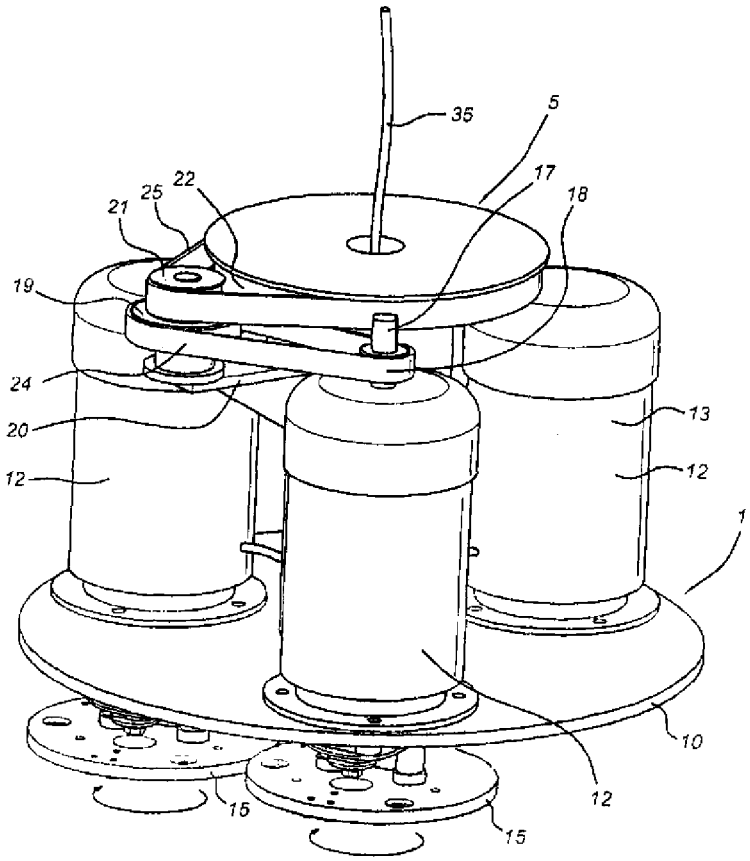

3 Claims, 5 Drawing Sheets